US009932702B2

(12) United States Patent
Jeong et al.

(10) Patent No.: US 9,932,702 B2
(45) Date of Patent: Apr. 3, 2018

(54) WASHING MACHINE

(71) Applicant: LG ELECTRONICS INC., Seoul (KR)

(72) Inventors: Jaeyong Jeong, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 442 days.

(21) Appl. No.: 14/523,230

(22) Filed: Oct. 24, 2014

(65) Prior Publication Data

US 2015/0114046 A1 Apr. 30, 2015

(30) Foreign Application Priority Data

Oct. 24, 2013 (KR) ..... 10-2013-0127368

(51) Int. Cl.

*D06F 39/08* (2006.01)
*D06F 39/02* (2006.01)
*D06F 39/12* (2006.01)

(52) U.S. Cl.

CPC ..... *D06F 39/088* (2013.01); *D06F 39/083* (2013.01); *D06F 39/02* (2013.01); *D06F 39/12* (2013.01)

(58) Field of Classification Search

CPC ..... D06F 39/08; D06F 39/083; D06F 39/088
See application file for complete search history.

(56) References Cited

U.S. PATENT DOCUMENTS 4,784,666 A * 11/1988 Brenner ..... D06F 35/005 68/17 R
4,987,627 A * 1/1991 Cur ..... D06F 35/006 68/148
5,167,722 A * 12/1992 Pastryk ..... D06F 35/006 134/33
6,185,774 B1 * 2/2001 Tubman ..... D06F 39/083 68/207
8,381,342 B2 * 2/2013 Pollett ..... D06F 13/00 8/159
2001/0047670 A1 * 12/2001 Whah ..... D06F 39/06 68/12.02

(Continued)

FOREIGN PATENT DOCUMENTS

CN 101858023 10/2010
JP 2002-282587 10/2002

OTHER PUBLICATIONS

Machine translation of JP 2002-282587 A, no date.*
Chinese Office Action dated Mar. 21, 2016 issued in Application No. 201410571690.6.

*Primary Examiner* — Joseph L Perrin
(74) *Attorney, Agent, or Firm* — KED & Associates, LLP

(57) ABSTRACT

Provided is a washing machine that includes a washing tub to accommodate laundry, the washing tub provided to be rotatable, and a liquid applicator that sprays a liquid to prescribed regions inside the washing tub. The liquid applicator may include a first nozzle having a first outlet arranged in a first direction to spray the liquid toward a first region of the washing tub, and a second nozzle having a second outlet arranged in a second direction to spray the liquid toward a second region of the washing tub. The first and second directions may be different directions.

16 Claims, 8 Drawing Sheets

(56) References Cited

U.S. PATENT DOCUMENTS

| | | | | |
|---|---|---|---|---|
| 2007/0067920 | A1* | 3/2007 | Zaccone | D06F 25/00 8/158 |
| 2007/0084000 | A1* | 4/2007 | Bernardino | D06F 39/02 8/158 |
| 2007/0107138 | A1* | 5/2007 | Bernardino | D06F 35/006 8/158 |
| 2009/0249838 | A1* | 10/2009 | Kim | D06F 39/088 68/58 |
| 2009/0249840 | A1* | 10/2009 | Jo | D06F 39/008 68/5 C |
| 2010/0236001 | A1* | 9/2010 | Lee | D06F 33/02 8/159 |
| 2010/0251784 | A1* | 10/2010 | Lee | D06F 23/04 68/200 |
| 2011/0088172 | A1* | 4/2011 | Im | D06F 33/02 8/137 |
| 2011/0100070 | A1* | 5/2011 | Kim | D06F 35/006 68/200 |
| 2012/0240638 | A1* | 9/2012 | Hettinger | D06F 39/088 68/200 |
| 2013/0145562 | A1* | 6/2013 | Lee | D06F 37/266 8/137 |
| 2014/0033449 | A1* | 2/2014 | Im | D06F 39/08 8/137 |
| 2015/0121969 | A1* | 5/2015 | Lim | D06F 37/267 68/131 |
| 2015/0128657 | A1* | 5/2015 | Kim | D06F 39/083 68/132 |
| 2015/0354122 | A1* | 12/2015 | Kwon | D06F 39/003 8/137 |

* cited by examiner (a)

(b)

WASHING MACHINE

CROSS-REFERENCE TO RELATED APPLICATION

This application claims priority under 35 U.S.C. § 119 to Korean Application No. 10-2013-0127368, filed on Oct. 24, 2013, whose entire disclosure is hereby incorporated by reference.

BACKGROUND

1. Field

Embodiments may relate to a washing machine.

2. Background

In general, a washing machine removes contaminants on clothes or bed linens (hereinafter, referred to as "laundry") using water, detergent, and mechanical actions.

Further, washing machines may be classified into top-load type washing machines with an laundry entrance/exit hole formed in an upper surface of the cabinet for entering and existing the laundry, which performs washing by a rotational water flow generated as the washing tub rotates and drum-type washing machines with a laundry entrance/exit hole formed in a front surface of the cabinet to perform washing by dropping water to the laundry as the drum rotates.

In the conventional top load type washing machines, however, the water supply unit and the detergent supply unit are disposed at a side of an upper portion of the cabinet, and thus, water and detergent may be forced to be supplied only to a lower portion of a side of the washing tub. Accordingly, the water and detergent are not evenly applied to the laundry. This may result in a deterioration of washing and rinsing performance.

BRIEF DESCRIPTION OF THE DRAWINGS

Embodiments will be described in detail with reference to the following drawings in which like reference numerals refer to like elements wherein.

DETAILED DESCRIPTION

Various advantages, features and methods of the present disclosure may become apparent upon referring to embodiments described later in detail together with attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification.

Figure 1:
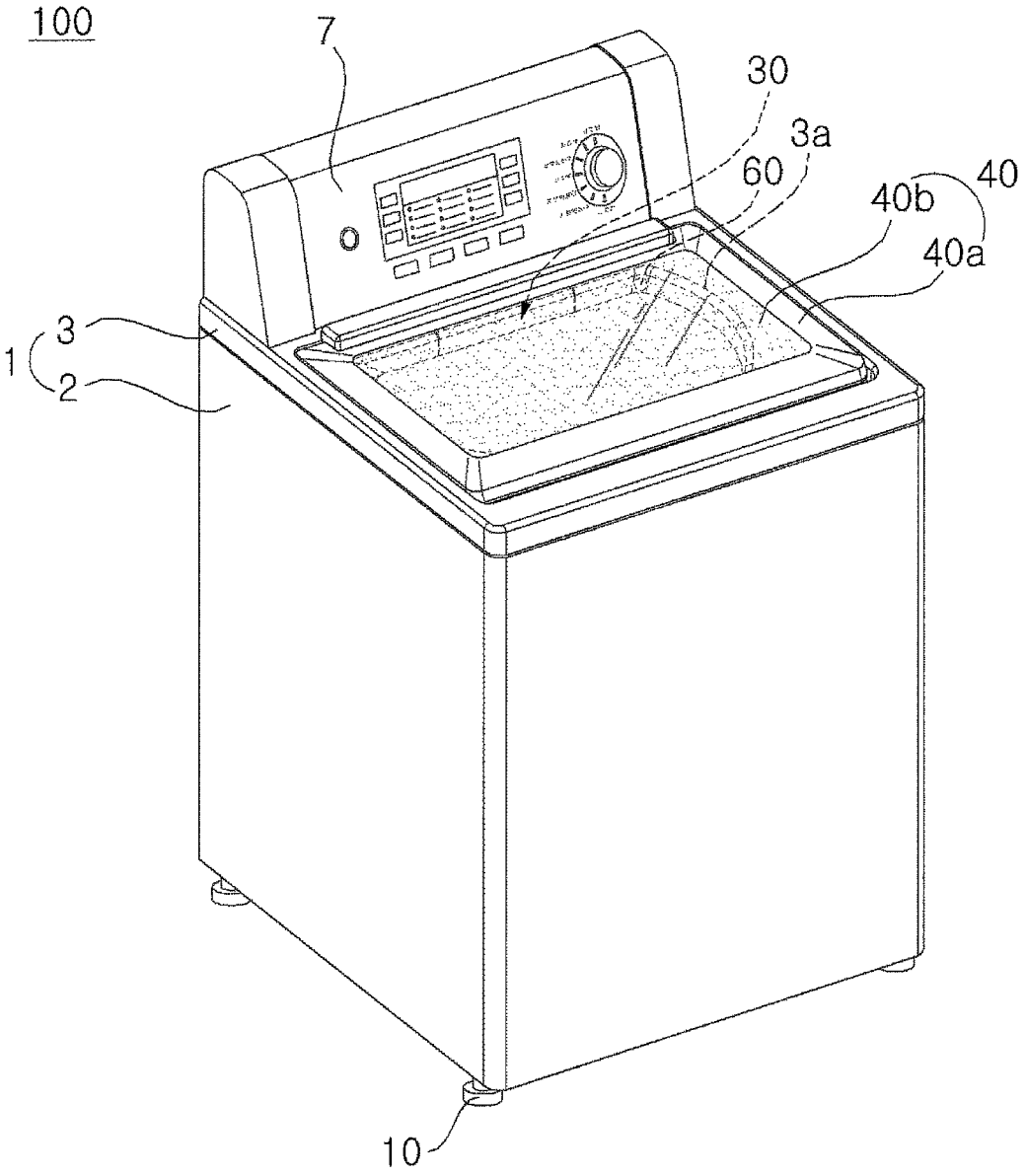
FIG. 1 is a perspective view illustrating a washing machine according to an embodiment of the present disclosure.
Figure 2:
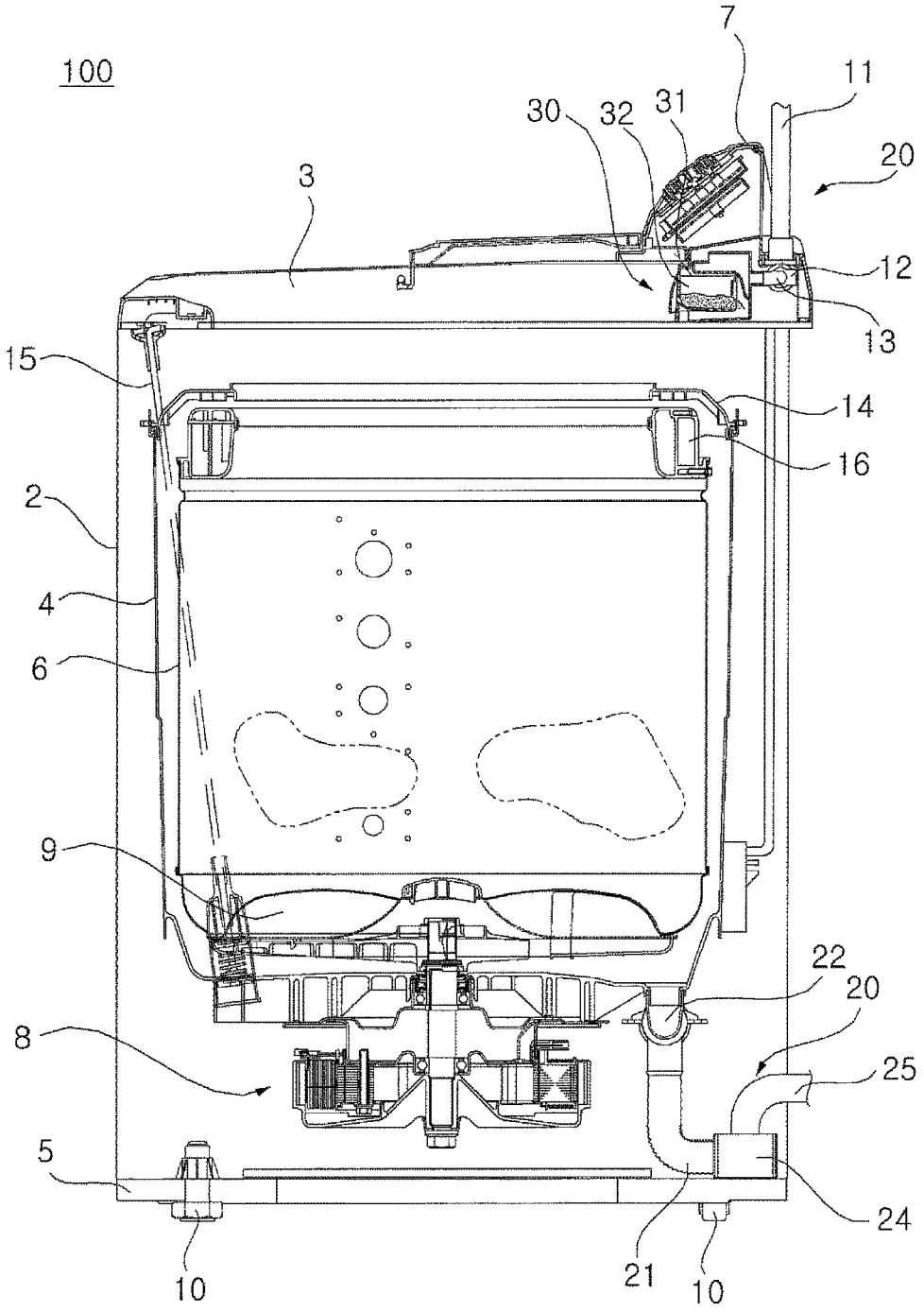
FIG. 2 is a side cross-sectional view illustrating a washing machine according to an embodiment of the present disclosure.

FIG. 1 is a perspective view illustrating a washing machine according to an embodiment of the present disclosure. FIG. 2 is a side cross-sectional view illustrating a washing machine according to an embodiment of the present disclosure. A washing machine 100 may include a casing 1 that forms an outer appearance and a leg assembly 10 coupled with a lower portion of the casing 1.

The casing 1 may be formed to have an upper surface and a lower surface which are open. The casing 1 may include a cabinet 2 that forms a side surface of the washing machine 100, a top cover 3 provided to cover the opened upper surface of the cabinet 2, and a base 5 provided at the opened lower surface of the cabinet 2.

The cabinet 2 may include a water storage tank 4 for storing water, a washing tub 6 disposed inside the water storage tank 4 to accommodate laundry, an actuator 8, e.g., for actuating the washing tub 6, a water supply assembly that supplies water to the inside of the water storage tank 4, and a water discharge assembly 20 for discharging water out of the water storage tank 4 after washing or dehydrating is complete. Further, the casing 1 may include a detergent supply unit 30 provided at the top cover 3 to temporarily store detergent. The detergent supply unit 30 may be formed to be coupled with the water supply assembly to supply water and detergent to the inside of the washing tub 6.

The top cover 3 may include a laundry opening 3*a* (also referred to herein as an entrance/exit hole) through which laundry may be placed in the washing tub 6. The top cover 3 may include a door 40 for opening and closing the laundry opening 3*a*. The door 40 may be at least partially formed of glass, thus allowing the inside to be viewed. That is, the door 40 may include a frame part 40*a* and a glass part 40*b* framed by the frame part 40*a*. Further, a display panel 7 may be mounted at a side of the top cover 3 for controlling an operation of the washing machine 100 or displaying the operational state of the washing machine 100.

The water storage tank 4 may be disposed to be hung on an internal upper portion of the cabinet 2 by a plurality of suspensions 15. An end of the suspension 15 may be coupled with an internal upper portion of the cabinet 2, and another end thereof may be coupled with a lower portion of the water storage tank 4.

A pulsator 9 may be provided on a lower surface of the washing tub 6 for generating a rotational water flow of the water contained in the water storage tank 4. The pulsator 9 may be integrally formed with the washing tub 6 so that when the motor rotates, the washing tub 6 and the pulsator 9 may be rotated together, or the pulsator 9 may be formed separately from the washing tub 6 so that as the motor rotates, the pulsator 9 is rotated separately from the washing tub 6.

A balancer 12 may be provided at an upper side of the washing tub 6 for preventing imbalance of the washing tub 6 that may occur as the laundry is forced to a side. A balancer 12 may be a liquid balancer that is filled with a liquid such as salt water. A water storage tank cover 14 may be provided at an upper side of the water storage tank 4 to prevent laundry from escaping or water from spilling out.

Figure 3:
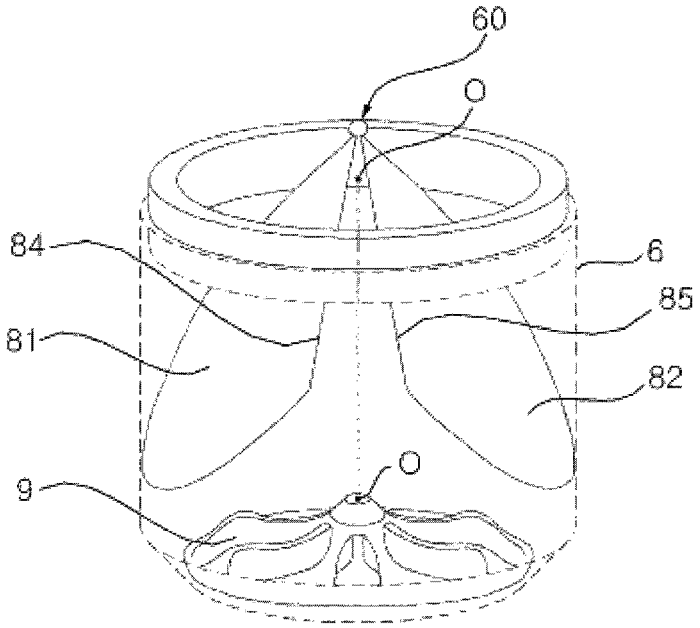
FIG. 3 illustrates an ejection pattern of washing water ejected from a liquid applicator unit according to an embodiment of the present disclosure.
Figure 4:
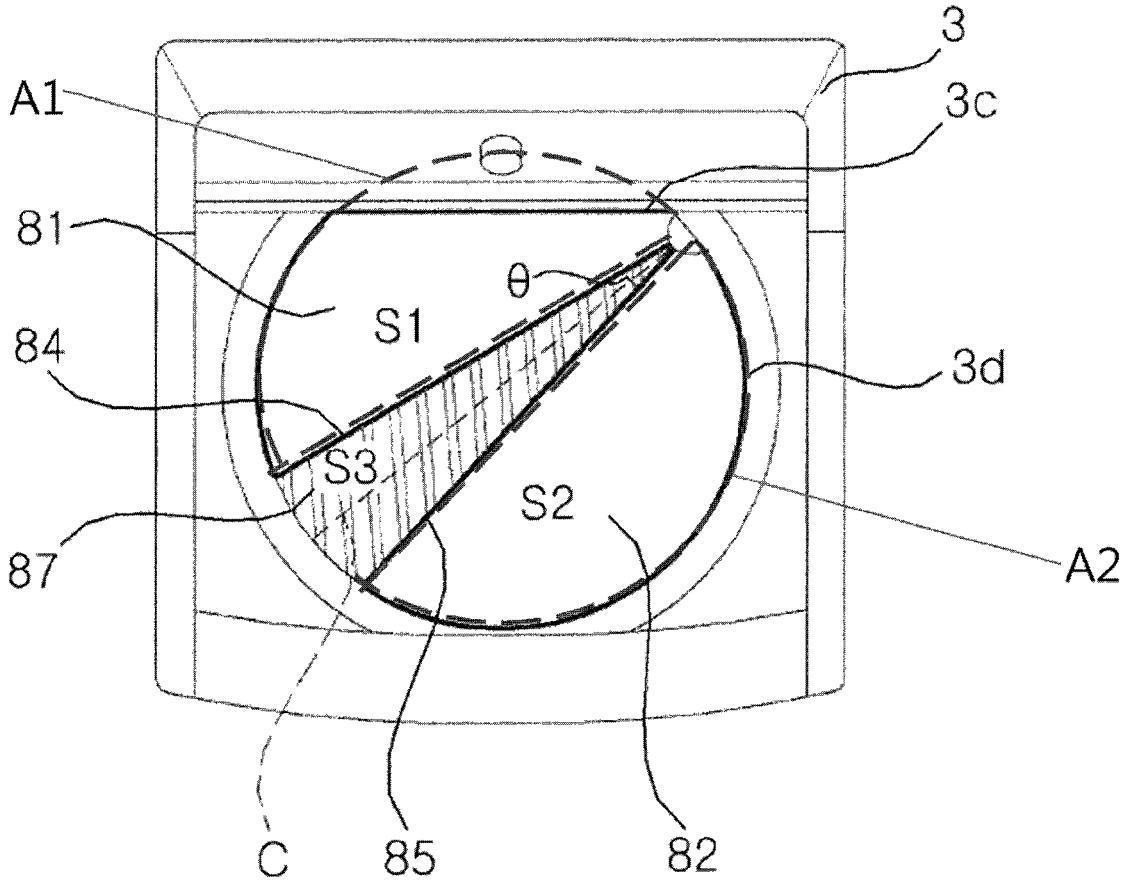
FIG. 4 illustrates an ejection pattern of washing water ejected from a liquid applicator unit as viewed from an upper side, according to an embodiment of the present disclosure.
Figure 5:
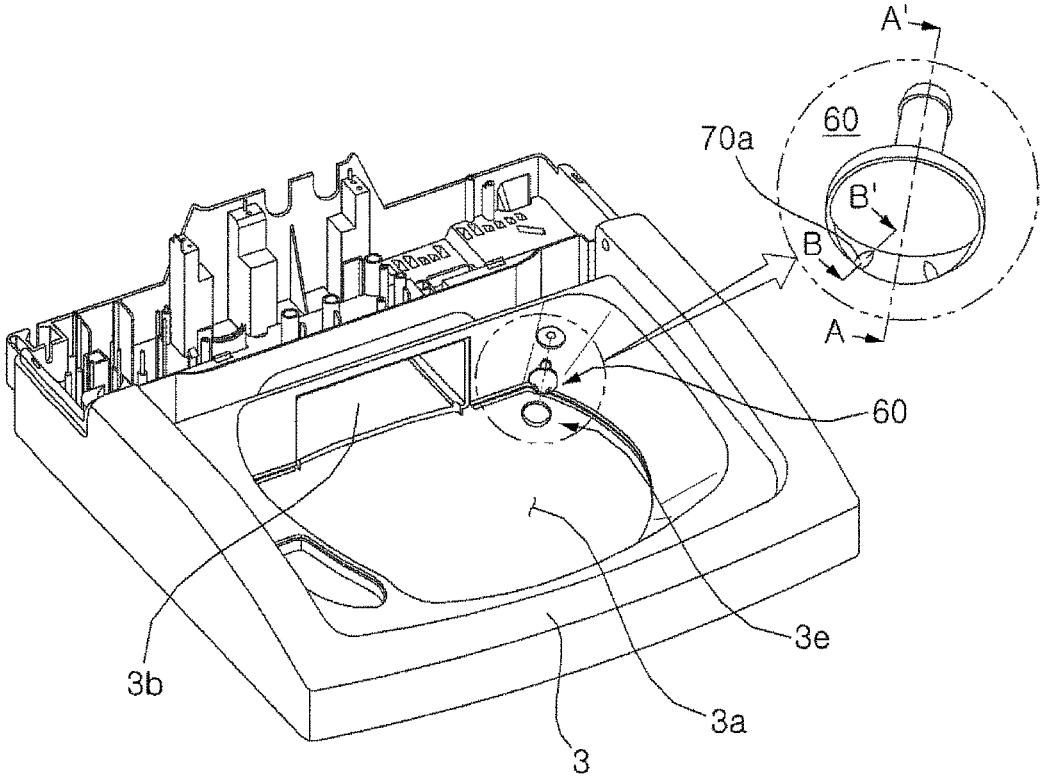
FIG. 5 is a perspective view illustrating a position where a liquid applicator unit is mounted, according to an embodiment of the present disclosure.

FIG. 3 illustrates an ejection pattern (or spray pattern) of washing water ejected from a liquid applicator unit according to an embodiment of the present disclosure. FIG. 4 illustrates an ejection pattern of washing water ejected from a liquid applicator unit as viewed from an upper side, according to an embodiment of the present disclosure. FIG. 5 is a perspective view illustrating a position where a liquid applicator unit is mounted, according to an embodiment of the present disclosure.

Figure 6:
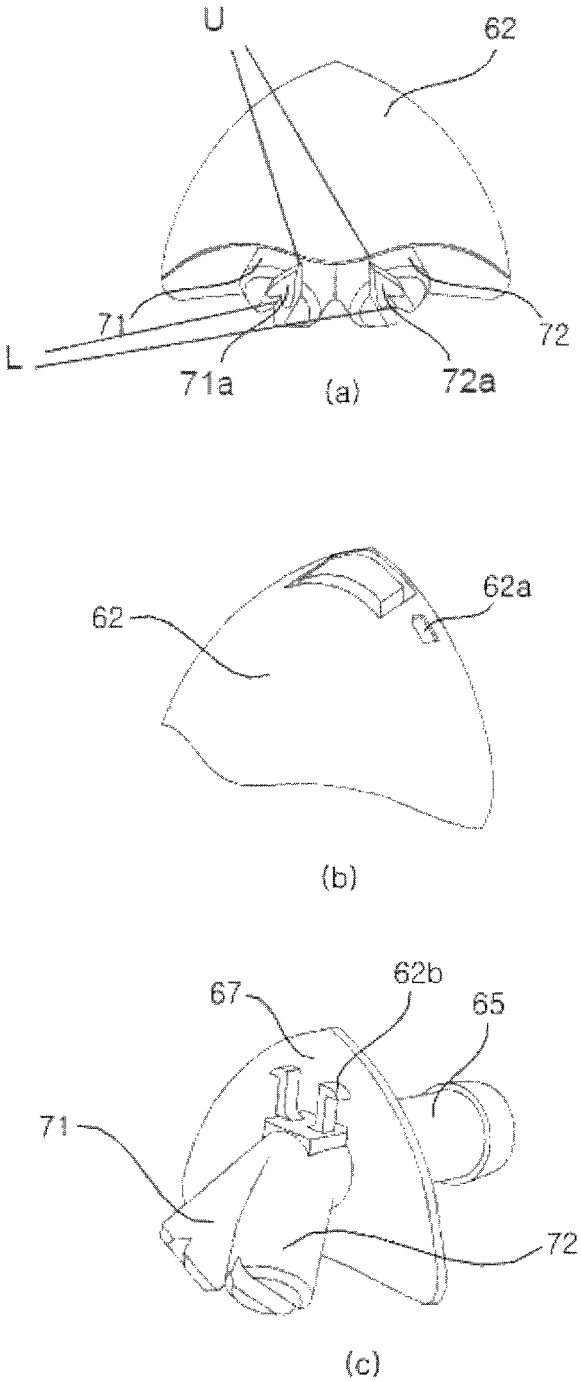
FIG. 6 schematically illustrates a liquid applicator unit according to an embodiment of the present disclosure.
Figure 7:
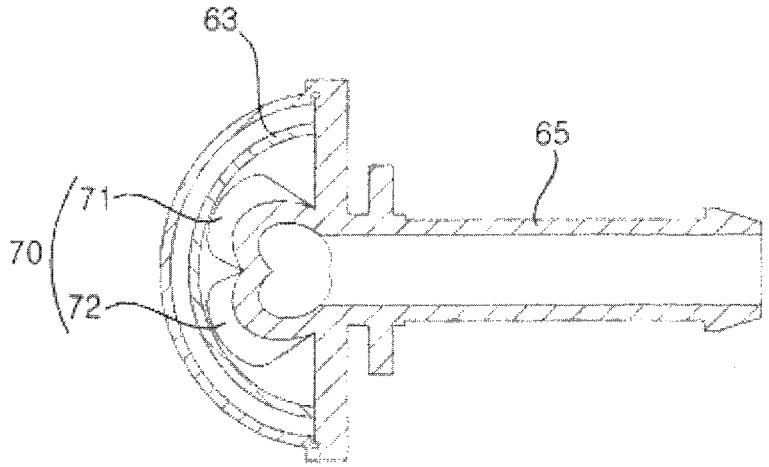
FIG. 7 illustrates a cross-sectional view taken along line A-A' of FIG. 3 and a cross-sectional view of an outlet of a nozzle.
Figure 7:
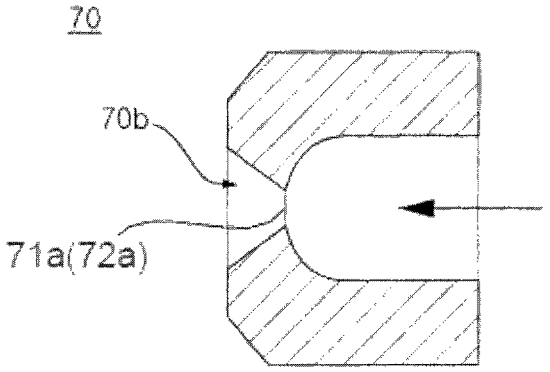
Figure 8:
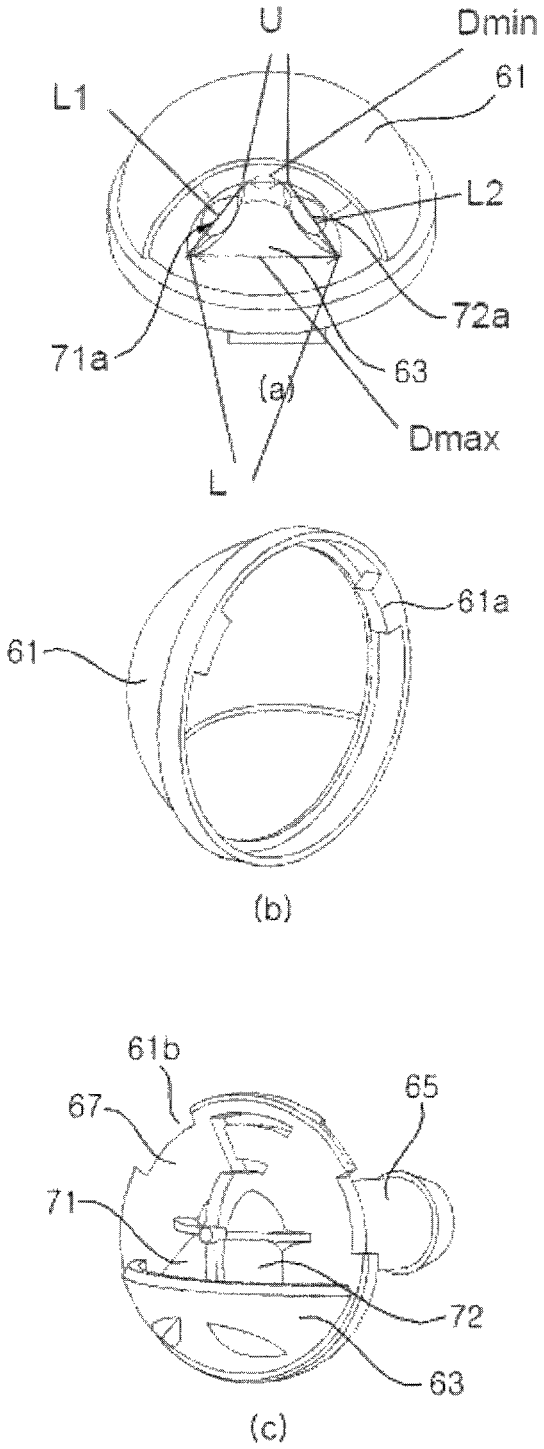
FIG. 8 schematically illustrates a liquid applicator unit according to another embodiment of the present disclosure.

Referring to FIGS. 3 to 5, the washing machine 100 may include a liquid applicator unit 60 for applying liquid (e.g., washing water) to the inside of the washing tub 6. The liquid applicator unit 60 may include a nozzle 70. A plurality of nozzles 70 may be provided. Hereinafter, as shown in FIGS. 6 to 8, the liquid applicator unit 60 is disclosed as including a first nozzle 71 and a second nozzle 72, for example. However, it should be appreciated that the number of nozzles is not be limited thereto. When a plurality of nozzles are provided, the respective coverage areas of the plurality of nozzles may not interfere with or overlap each other. Moreover, the first nozzle 71 and the second nozzle 72 may be formed as a single body.

As illustrated in FIGS. 3 and 4, the first nozzle 71 and the second nozzle 72 each may eject or spray washing water in a flat fan pattern (hereinafter, referred to as flat fan liquid applicator pattern). The first flat fan area 81 may represent a liquid applicator pattern generated by the first nozzle 71, and the second flat fan area 82 may represent a liquid applicator pattern generated by the second nozzle 72.

The first flat fan area 81 and/or the second flat fan area 82 may be formed at an incline, as illustrated in FIG. 3. The first flat fan area 81 and/or the second flat fan area 82 may represent washing water ejected with a relatively large width and small thickness. The spray of washing water may be sprayed as a sheet, curtain, or the like. The first flat fan area 81 and/or the second flat fan area 82 may be created by the nozzle 70. Although the first flat fan area 81 and/or the second flat fan area 82 may be created by a single nozzle 70, an example is illustrated in the instant embodiment in which the first flat fan area 81 and/or the second flat fan area 82 are formed by a plurality of nozzles 70.

The first flat fan area 81 and/or the second flat fan area 82 may be formed at an incline in the washing tub 6. In this manner, the washing water may be ejected to cover a broader area, thus soaking the laundry in the maximum area within a short amount of time. The first nozzle 71 may have a first outlet 71*a* for spraying washing water to a first region A1 in the washing tub 6, and the second nozzle 72 may have a second outlet 72*a* spraying washing water to the second region A2 in the washing tub 6. The first region A1 may be provided to not interfere with or overlap the second region A2, and in such case, a non-interference area 87 may be formed between the first region A1 and the second region A2 where the washing water does not reach. As viewed from above, the non-interference area 87 may be formed between an upper edge 84 of the first flat fan area 81 and an upper edge 85 of the second flat fan area 82, as illustrated in FIG. 4 (See also FIG. 3).

Although the laundry contained in the washing tub 6 may overlap the first flat fan area 81 or the second flat fan area 82 depending on the height of the contained laundry, the laundry present in the non-interference area 87 may not overlap the first flat fan area 81 and the second flat fan area 82, and hence, not covered by the washing liquid. However, as the washing tub 6 rotates, the laundry may be rendered to overlap the first flat fan area 81 and/or the second flat fan area 82.

Referring again to FIG. 4, as the washing tub 6 is viewed from above, the area S1 of the first region A1, the area S2 of the second region S2, and the area S3 of the non-interference area 87 may have the following relationship: (S1+S2):S3=7:3 through 9:1, preferably (S1+S2):S3=8:2. Meanwhile, depending on the spray ranges of the nozzles 71 and 72, areas S1 and S2, respectively, may correspond to areas obtained by projecting the first flat fan area 81 and the second flat fan area 82 onto a horizontal surface.

As such, because the first flat fan area 81 and the second flat fan area 82 are separated by the non-interference area 87 to prevent interference or overlap, the washing liquid does not collide with each other and may more easily reach a wall surface of the washing tub 6 or the laundry. Accordingly, the washing water may, with excellent directivity, soak a maximum area over the laundry within a short amount of time.

Referring to again to FIGS. 3 and 4, the rotational center (o-o') of the washing tub 6 may be positioned in the non-interference area 87. Here, the rotational center (o-o') may be defined on the same line as the rotational axis of the motor that rotates the washing tub 6. The liquid applicator unit 60 may be disposed towards the rotational center (o-o'). The washing tub 6 may rotate about the rotational center (o-o'), and the first flat fan area 81 and the second flat fan area 82 may be provided at both sides with respect to the rotational center (o-o'). Such an arrangement may allow the liquid applicator unit 60 to be disposed in a direction to evenly eject washing water with the maximum liquid applicator area of washing water.

The non-interference area 87 may have a fan shape. The arc of the fan-shaped portion may be formed on an inner wall of the washing tub 6. The radius of the fan-shaped portion may be formed by upper edges 84 and 85. The center of the fan-shaped portion may be formed substantially at a portion where the liquid applicator unit 60 is positioned. The center of the fan-shaped portion may also be formed at a nozzle coupling part 3*e*.

The non-interference area 87, as viewed from above the washing tub 6, may have a range from 0 degrees to 26 degrees with respect to the center of the nozzle 70. Here, the angle may define a range of the non-interference area 87 and may be formed by the upper edges 84 and 85. The angle may be preferably 18 degrees. In particular, the angle defining the range of the non-interference area 87 may also be defined as an angle between a liquid applicator direction of an upper side U of the first nozzle 71 and a liquid applicator direction of an upper side U of the second nozzle 72, as illustrated in FIG. 6. That is, the upper edges 84 and 85 may correspond to washing liquid sprayed from the upper side U of the nozzles 71 and 72, which are configured to face different directions by a prescribed angle to form the non-interference area 87. Meanwhile, as illustrated in FIG. 4, the center line c may be the diameter of the washing tub 6, evenly bisecting the non-interference area 87.

Referring to FIG. 5, the washing machine 100 may further include a top cover 3 that has the laundry opening 3*a* through which laundry may be placed. The liquid applicator unit 60 may be disposed at the top cover 3. The top cover 3 may have a detergent box receiving part 3*b* at a side towards the laundry opening 3*a*. The detergent box receiving part 3*b* may have the detergent box 32 disposed therein. The top cover 3 may have a nozzle coupling part 3*e* coupled with the liquid applicator unit 60.

The nozzle coupling part 3*e* may be formed at a position spaced apart from the detergent box receiving part 3*b* in a lateral direction. However, without being limited thereto, the nozzle coupling part 3*e* may also be formed in the top cover 3 at a different position towards the laundry opening 3*a*.

The liquid applicator unit 60 may be fed with wash liquid through a water supply hose 13 or through the detergent box 32. Merely for ease of description, the present disclosure describes an exemplary configuration in which the liquid applicator unit 60 is fed with wash liquid through the water supply hose 13.

That is, the liquid applicator unit 60 may be connected with a water supply hose for the nozzle 70, which is branched from the water supply hose 13 and ejects the water that has sequentially passed through the water supply hose 13 and the water supply hose for nozzle 70. The water supply hose for nozzle 70 may have a separate water supply valve for nozzle 70 to switch on/off the water that is supplied to the liquid applicator unit 60. Meanwhile, without being limited thereto, the water supply hose for nozzle 70 may be connected with the liquid applicator unit 60 may be disposed separately from the water supply hose 13 rather than being branched from the water supply hose 13. The nozzle supply pipe 65 may be inserted into the nozzle coupling part 3*e* of the top cover 3.

The top cover 3 may include the detergent box receiving part 3*b* opened to receive the detergent box, a flat detergent box support extended to the left and right from the detergent box receiving part 3*b*, and a rim part 3*d* extended from the detergent box support and bent to form the laundry opening 3*a*. The liquid applicator unit 60 may be disposed at the rim part 3*d*.

The water supply assembly may include an external hose 11 that guides the water supplied from, e.g., an external faucet to the washing machine 100, a water supply valve 12 connected with the external hose 11 to switch on/off water supply, and a water supply hose 13 connecting the water supply valve 12 with the detergent supply unit 30. The water supply valve 12 and the water supply hose 13 may form a water supply flow path for water supply.

The detergent supply unit 30 may be disposed on the water supply flow path. The detergent supply unit 30 may include a detergent box receiving part 3*b* provided to communicate with the water supply hose 13, a detergent box 32 detachably received in the detergent box receiving part 3*b*, and a detergent box cover fixed to the detergent box receiving part 3*b* and disposed at an upper surface of the detergent box 32 to eject water. The detergent box receiving part 3*b* may be installed in the detergent box receiving part 3*b* formed at a side of the top cover 3. The detergent box 32 may be coupled with the detergent box receiving part 3*b* to be withdrawn from the detergent box receiving part 3*b* so that the user may put in detergent. The detergent box 32 may be slidably coupled with the detergent box receiving part 3*b* to slide in front and rear directions. At least a portion of a rear surface of the detergent box 32 may be opened so that when water is supplied the detergent, together with water, may flow into the detergent box receiving part 3*b* through the rear surface of the detergent box 32.

The water discharge assembly 20 may include a first water discharge hose 21 connected with a lower portion of the water storage tank 4, a water discharge valve 22 provided on the first water discharge hose 21 to switch on/off water discharge, a water discharge housing 24 including a water discharge pump for pumping water, and a second water discharge hose 25 connected with the water discharge housing 24 to discharge the water pumped by the water discharge pump to the outside of the cabinet 2. A water discharge motor may be placed within the water discharge housing 24 to actuate the water discharge pump. The water discharge assembly 20 may be disposed between the water storage tank 4 and the base 5.

The detergent box support 3*c* may be formed to be substantially flat. The detergent box support 3*c* may be formed to be horizontally elongated. The rim part 3*d* may be formed to be curved with substantially the same curvature as the washing tub 6. Moreover, the rim part 3*d* may be vertical or set at a prescribed angle relative to the washing tub 6. The liquid applicator unit 60 may be disposed on the rim part 3*d*.

According to an embodiment of the present disclosure, a side end of the liquid applicator unit 60 may be disposed at a position where the rim part 3*d* is connected with the detergent box support. The rim part 3*d* may have the nozzle coupling part 3*e* provided thereon. The nozzle supply pipe 65 may be inserted into the nozzle 70 coupling part 3*e*. The nozzle coupling part 3*e* may be coupled with a supporting plate 67. The nozzle coupling part 3*e* may be coupled with the nozzle supply pipe 65. The curvature may vary at the position where the rim part 3*d* is connected with the detergent box support. A side end of the liquid applicator unit 60 may be disposed at a position where the curvature varies.

FIG. 6 schematically illustrates a liquid applicator unit according to an embodiment of the present disclosure. FIG. 7 illustrates a cross-sectional view taken along line A-A' of the liquid applicator unit and a cross-sectional view taken along line B-B' of an outlet of a nozzle of FIG. 5. FIG. 8 schematically illustrates a liquid applicator unit according to another embodiment of the present disclosure.

Referring to FIGS. 6 through 8, according to embodiments of the present disclosure, the liquid applicator unit 60 may include a first nozzle 71 having a first outlet 71*a* for spraying washing water to the first region A1 in the washing tub 6 and a second nozzle 72 having a second outlet 72*a* for spraying washing water to the second region A2 in the washing tub 6.

Each outlet 71*a* and 72*a* may have an upper side U and a lower side L, and the length of the outlets 71*a* and 72*a* may be defined as the distance between the upper side U and the lower side L. The upper side U may eject washing water towards a side surface of the washing tub 6, and the lower side L may eject washing water towards a region lower than the upper side U. Straight lines L1 and L2 connecting the upper side U with the lower side L may be inclined with respect to the horizontal surface. In this case, the first straight line L1 and the second straight line L2 may be inclined in opposite directions from each other. When washing water is introduced into at least one of the first nozzle 71 and the second nozzle 72 with a sufficient amount of pressure, the washing water ejected through at least one of the first outlet 71*a* and the second outlet 72*a* may reach the washing tub 6.

The interval or distance between the first outlet 71*a* and the second outlet 72*a* may increase from the upper side U towards the lower side L along a longitudinal direction of the outlets 71*a*, 72*a*. As illustrated in FIG. 8, the distance between the first outlet 71*a* and the second outlet 72*a* may be shortest between upper sides U, and as measured along a longitudinal direction of the outlets from the upper side U, the distance may gradually increase and may be greatest between the lower sides L.

As illustrated in FIG. 6, the first nozzle 71 and the second nozzle 72 may be formed to be split in different directions from each other. The first nozzle 71 and the second nozzle 72 may be connected with a nozzle supply pipe 65 to be described below. The first nozzle 71 and the second nozzle 72 may be connected with a supporting plate 67.

The outlets 71*a* and 72*a* may be slits that extend along lines L1 and L2. The respective outlets 71*a* and 72*a* of the nozzles 71 and 72 may each be formed to have an elongated, notch-shaped cross section, for example, as illustrated in FIGS. 6(*a*) and 7(*b*). In this case, the outlets may be configured to eject washing water in different directions from each other.

The notch 70*b* may have a V-shape, as illustrated in FIG. 7(*b*). An outlet 70*a* may be formed at an end of the first nozzle 71 and the second nozzle 72. The notch 70*b* may be formed at an incline to provide the first flat fan area 81 and the second flat fan area 82. As such, a plurality of flat fan areas may be formed by the first nozzle 71 and the second nozzle 72.

According to an embodiment of the present disclosure, the liquid applicator unit 60 may further include nozzle covers 61 and 62 that covers the first nozzle 71 and the second nozzle 72, a nozzle supply pipe 65 through which washing water flows to the first nozzle 71 and the second nozzle 72, and a supporting plate 67 having the nozzle supply pipe 65 may pass therethrough and fixed to the nozzle covers 61 and 62.

The nozzle covers 61 and 62 may be disposed at upper sides of the first nozzle 71 and the second nozzle 72. The nozzle covers 61 and 62 may be disposed so that the laundry, upon moving, does not stick to or is obstructed by the first nozzle 71 and the second nozzle 72. The nozzle covers 61 and 62 may preferably be formed to be rounded to prevent the laundry from catching onto the nozzles 70 when the laundry moves. The nozzle supply pipe 65 may be inserted into the nozzle coupling part 3*e*. The nozzle supply pipe 65 may be formed to penetrate the supporting plate 67. The supporting plate 67 may be fastened to the nozzle covers 61 and 62. The supporting plate 67 may prevent the nozzle covers 61 and 62 from being pushed. The nozzle covers 61 and 62 may preferably be fixed to the supporting plate 67, brought in tight contact with the supporting plate 67, so that the laundry, upon moving, does not stick to or is obstructed by the supporting plate 67.

The supporting plate 67 may include a holding groove 61*b*, and the nozzle cover 61 may include a holding protrusion 61*a* that is coupled to the holding groove 61*b*. The nozzle cover 61 may be rotated such that the protrusion 61*a* and groove 61*b* may mate with each other such that the protrusion 61*a* may be hung on a rear surface of the supporting plate 67.

The supporting plate 67 may have the holding groove 61*b*. The holding groove 61*b* may be shaped to match the holding protrusion 61*a* to allow the holding protrusion 61*a* to be inserted therein or may be larger in size than the holding protrusion 61*a*. The holding protrusion 61*a* may be brought in tight contact with the rear surface of the supporting plate 67 when the nozzle covers 61 and 62 are rotated. A plurality of holding grooves 61*b* may be provided. The holding protrusion 61*a* may be formed to rotate, wrapping around the outer circumferential surface of the supporting plate 67.

According to an embodiment of the present disclosure, the supporting plate 67 may have a projected insertion cone 62*b*, and the nozzle cover 62 may have an insertion hole 62*a* into which the insertion cone 62*b* is inserted to allow the nozzle cover 62 to be fixed to the supporting plate 67. The projected insertion cone 62*b* may have a variety of shapes such as a hook, and the insertion hole 62*a* may have a variety of shapes to accommodate the insertion cone 62*b* such as a notch, hole, catch or the like.

The insertion cone 62*b* may be formed on the supporting plate 67 or the nozzle 70. The insertion cone 62*b* may be formed to be projected towards the nozzle covers 61 and 62. The nozzle covers 61 and 62 may have the insertion hole 62*a* that permits insertion of the insertion cone 62*b*. The insertion hole 62*a* may match in shape the insertion cone 62*b*.

According to an embodiment of the present disclosure, the liquid applicator unit 60 may further include a holding preventing plate 63 that is extended from a lower side of the supporting plate 67 to wrap around the first nozzle 71 and the second nozzle 72 in order to prevent the laundry from being stuck to the first nozzle 71 and the second nozzle 72, for example, when removing the laundry from the washing tub 6.

The holding preventing plate 63 may be integrally formed with the supporting plate 67. The supporting plate 67 may be integrally formed with the liquid applicator nozzle 70. The supporting plate 67 may be integrally formed with the insertion cone 62*b*. The holding preventing plate 63 may prevent the laundry contained in the washing tub 6 from being stuck by the nozzle 70 when the laundry is removed through the laundry opening 3*a* to the outside. The holding preventing plate 63 may preferably be formed to be rounded to prevent the laundry from being stuck thereto.

According to an embodiment of the present disclosure, the holding preventing plate 63 and the nozzle covers 61 and 62 may meet each other, thus forming a semi-sphere shape. That is, the holding preventing plate 63 and the nozzle covers 61 and 62 may be shaped to form a portion of a sphere. Preferably, the shape may be semi-spherical or may be smaller than a semi-sphere. Such shape may minimize the laundry being stuck or caught, while also preventing the user from being scratched by the liquid applicator unit 60. The holding preventing plate 63 may be a lower cover and the nozzle covers 61 and 62 may be an upper cover. The upper and lower covers may comprise a cover for the nozzle to prevent snagging against the laundry, the user, or the like.

According to an embodiment of the present disclosure, a washing machine 100 may include a water storage tank, a washing tub 6 rotatably disposed inside, the water storage tank 4, and a notch 70*b* formed at an outlet 70*a* to allow water to be ejected in a flat fan pattern towards the washing tub 6. A plurality of outlets 70*a* may be provided to form a plurality of flat fan patterns.

The outlets 70*a* may be formed to be spaced apart from each other. The outlets 70*a* may be separated from each other with respect to a central line so that washing water may be split with respect to a rotational center (o-o') of the washing tub 6, so that the flat fan pattern may be inclinedly formed to form mountains and valleys.

According to an embodiment of the present disclosure, a washing machine may comprise a washing tub into which laundry is inserted, the washing tub provided to be rotatable; and a liquid applicator ejecting a liquid to an inside of the washing tub, wherein the liquid applicator comprises a first nozzle having a first outlet through which the liquid is ejected toward a first region of the washing tub; and a second nozzle having a second outlet through which the liquid is ejected toward a second region of the washing tub.

Each of the outlets may include an upper side and a lower side defining a length thereof, wherein the upper side may eject the liquid toward a side surface of the washing tub, and the lower side may eject the liquid toward a portion lower than the upper side.

An angle between an ejection direction of the upper side of the first nozzle and an ejection direction of the upper side of the second nozzle may be larger than 0 degrees and smaller than 26 degrees.

An interval between the first outlet and the second outlet gradually may increase from the upper side to the lower side along a longitudinal direction of the outlet.

A straight line connecting the upper side with the lower side may be inclined with respect to a horizontal surface. A first straight line connecting the upper side and lower side of the first nozzle and a second straight line connecting the upper side and lower side of the second nozzle may be inclined in opposite directions from each other.

The liquid ejected through at least any one of the first outlet and the second outlet may reach a side surface of the washing tub when the liquid is introduced with a sufficient pressure to at least one of the first nozzle and the second nozzle.

The first region and the second region may not interfere with each other. A rotational center of the washing tub may be positioned between the first region and the second region.

The washing machine may further comprise a top cover disposed at an upper side of the washing tub, the top cover having a laundry entrance/exit hole through which laundry may be entered, wherein the liquid applicator may be disposed at the top cover. The top cover may include a detergent box receiving part opened to receive a detergent box, a detergent box support in a lateral direction from the detergent box receiving part, and a rim part extended from the detergent box support and bent to form the laundry entrance/exit hole, wherein the liquid applicator may be disposed at the rim part. The liquid applicator may include a side end disposed at a point where the rim part is connected with the detergent box support.

At least one of the first outlet and the second outlet may have a V-shaped cross section that increases the area of flow path from an inlet through which the liquid flows to the outlet.

The liquid applicator may further include nozzle covers covering the first nozzle and the second nozzle; a nozzle supply pipe through which the liquid flows to the first nozzle and the second nozzle; and a supporting plate through which the nozzle supply pipe passes and to which the nozzle covers are fixed.

The supporting plate may have a holding groove, and the nozzle covers may include a holding protrusion that is projected to be hung on a rear surface of the supporting plate as the holding protrusion is inserted into the holding groove and rotates.

The supporting plate may have a projected insertion cone, and the nozzle covers may have an insertion hole into which the insertion cone is inserted so that the nozzle covers are fixed to the supporting plate.

The liquid applicator may further include a holding preventing plate extended from a lower side of the supporting plate to wrap around the first nozzle and the second nozzle so that the laundry does not interfere with the first nozzle and the second nozzle upon entering or exiting the washing tub. The holding preventing plate and the nozzle covers may meet each other to form a semi-circle.

According to an embodiment of the present disclosure, a washing machine may comprise a washing tub into which laundry is inserted, the washing tub provided to be rotatable; and a plurality of nozzles ejecting a liquid to an inside of the washing tub, each of the plurality of nozzles having an elongated outlet having a notch-shaped cross section, and wherein each outlet may be configured to eject the liquid in a different direction from an ejection direction of another outlet. An ejection region of each of the plurality of nozzles may not interfere with an ejection region of another nozzle.

As broadly described and embodied herein, the washing machine may evenly soak laundry. The washing machine may eject washing water in a broad area, thus quickly soaking laundry. Moreover, the washing machine may prevent interference between liquids ejected from different nozzles, thereby able to more efficiently soak laundry.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine, comprising:

a washing tub to accommodate laundry, the washing tub provided to be rotatable; and a liquid applicator that sprays a liquid to prescribed regions inside the washing tub, wherein the liquid applicator includes:

a first nozzle having a first outlet to spray the liquid toward a first region of the washing tub, the first outlet being elongated from an upper side to a lower side of the first outlet, and a second nozzle having a second outlet to spray the liquid toward a second region of the washing tub, the second outlet being elongated from an upper side to a lower side of the second outlet, the first outlet and the second outlet being substantially symmetrically disposed about a predetermined plane, wherein in each of the first and second nozzle, the liquid sprayed along the upper side of the respective outlet is directed higher than the liquid sprayed along the lower side of the same respective outlet, wherein a distance between the upper side of the first outlet and the upper side of the second outlet is less than a distance between the lower side of the first outlet and the lower side of the second outlet.

2. The washing machine of claim 1, wherein the upper side of the first nozzle is positioned relative to the upper side of the second nozzle such that an angle between a spray direction of the upper side of the first nozzle and a spray direction of the upper side of the second nozzle is greater than 0 degrees and less than 26 degrees.

3. The washing machine of claim 1, wherein each of the outlets are arranged at prescribed angles relative to the washing tub.

4. The washing machine of claim 3, wherein the first outlet is angled in a first direction and the second outlet is angled in a second direction bilaterally symmetric to the first direction.

5. The washing machine of claim 1, wherein the first nozzle and the second nozzle are configured such that the liquid sprayed through respective outlets of the first and second nozzles reaches a side surface of the washing tub when the liquid is introduced at a prescribed pressure to the first nozzle and the second nozzle.

6. The washing machine of claim 1, wherein the first region of the washing tub corresponding to the first nozzle and the second region of the washing tub corresponding to the second nozzle do not overlap each other.

7. The washing machine of claim 6, wherein a rotational center of the washing tub is positioned between the first region and the second region.

8. The washing machine of claim 1, further comprising a top cover disposed at an upper side of the washing tub, the top cover having a laundry opening for placing laundry in the washing tub, wherein the liquid applicator is disposed at the top cover.

9. The washing machine of claim 8, wherein the top cover includes a detergent box receiving part to receive a detergent box, a detergent box support provided in a lateral direction from the detergent box receiving part, and a rim part that extends from the detergent box support and bent to form the laundry opening, wherein the liquid applicator is disposed at the rim part.

10. The washing machine of claim 9, wherein the liquid applicator includes a side end disposed at a point where the rim part is connected with the detergent box support.

11. The washing machine of claim 1, wherein at least one of the first outlet and the second outlet has a V-shaped cross section that increases an area of a flow path from an inlet through which the liquid flows to the outlet.

12. The washing machine of claim 1, wherein the liquid applicator includes:

a nozzle cover that covers the first nozzle and the second nozzle, a nozzle supply pipe through which the liquid flows to the first nozzle and the second nozzle, and a supporting plate through which the nozzle supply pipe passes and to which the nozzle cover are fixed.

13. The washing machine of claim 12, wherein the supporting plate includes a holding groove and the nozzle cover includes a holding protrusion configured to couple to the holding groove, the holding protrusion being configured to rotatably couple to the holding groove and to couple to a rear surface of the supporting plate.

14. The washing machine of claim 12, wherein the supporting plate includes a hook and the nozzle cover includes an insertion hole into which the hook is inserted, the hook and insertion hole provided to couple to each other to fix the nozzle cover to the supporting plate.

15. The washing machine of claim 12, wherein the liquid applicator further includes a bottom cover that extends from a lower side of the supporting plate to wrap around the first nozzle and the second nozzle, the bottom cover having a prescribed shape to prevent interference with the laundry provided in the washing tub.

16. The washing machine of claim 15, wherein bottom cover and the nozzle cover are configured to couple to each other and have prescribed shapes to form a semi-circle.

* * * * *